US009826826B2

(12) United States Patent
McGonagle

(10) Patent No.: US 9,826,826 B2
(45) Date of Patent: Nov. 28, 2017

(54) VOTING BOOTH ASSEMBLY

(71) Applicant: PAKFLATT (UK) LIMITED, Londonderry (GB)

(72) Inventor: Patrick McGonagle, Derry (GB)

(73) Assignee: PAKFLATT (UK) LIMITED, Londonderry (GB)

( * ) Notice: Subject to any disclaimer, the term of this patent is extended or adjusted under 35 U.S.C. 154(b) by 0 days.

(21) Appl. No.: 15/030,365

(22) PCT Filed: Oct. 18, 2014

(86) PCT No.: PCT/EP2014/072381
§ 371 (c)(1),
(2) Date: Apr. 18, 2016

(87) PCT Pub. No.: WO2015/055853
PCT Pub. Date: Apr. 23, 2015

(65) Prior Publication Data

US 2016/0255949 A1 Sep. 8, 2016

(30) Foreign Application Priority Data

Oct. 18, 2013 (GB) ..... 1318485.8

(51) Int. Cl.
*A47B 19/08* (2006.01)
*A47B 43/00* (2006.01)
(Continued)

(52) U.S. Cl.
CPC ..... *A47B 19/08* (2013.01); *A47B 19/10* (2013.01); *A47B 43/00* (2013.01); *E04H 1/1255* (2013.01)

(58) Field of Classification Search
CPC ..... A47B 43/00
(Continued)

(56) References Cited

U.S. PATENT DOCUMENTS 3,389,947 A 6/1968 Kelley et al.
3,583,760 A * 6/1971 McGregor ..... A47B 5/006 297/145
(Continued)

FOREIGN PATENT DOCUMENTS

DE 299 13 652 U1 8/1999

OTHER PUBLICATIONS

International Search Report from parent PCT Application No. PCT/EP2014/072381, 3 pages (dated Jan. 22, 2015).

*Primary Examiner* — Matthew Ing
(74) *Attorney, Agent, or Firm* — Klarquist Sparkman, LLP

(57) ABSTRACT

The present disclosure relates to a voting booth assembly. In particular, the present disclosure relates to a voting booth assembly comprising at least one extendable panel adapted for positioning the extendable panel adjacent a substantially planar structure to define a voting compartment between the extendable panel and the substantially planar structure. The voting booth is operable between a collapsed state and an expanded state, thereby providing a temporary voting booth for use as a private area within the polling station for voters to cast their vote when otherwise-used facilities act as a polling station, and which can be easily assembled and/or disassembled for ease of transport and storage during times when the facility does not act as a polling station.

14 Claims, 9 Drawing Sheets

(51) Int. Cl.
*E04H 1/12* (2006.01)
*A47B 19/10* (2006.01)

(58) Field of Classification Search
USPC ..... 312/258; 108/115; 297/145
See application file for complete search history.

(56) References Cited

U.S. PATENT DOCUMENTS

| | | | |
|---|---|---|---|
| 4,854,652 | A | 8/1989 | Ahmann |
| 2002/0092443 | A1 | 7/2002 | Grant |
| 2011/0285100 | A1 | 11/2011 | Pazhoor |

* cited by examiner

VOTING BOOTH ASSEMBLY

CROSS REFERENCE TO RELATED APPLICATIONS

This is a §371 U.S. national stage of International Application No. PCT/EP2014/072381, filed Oct. 18, 2014, which was published in English under PCT Article 21(2), which claims priority to Great Britain Application No. GB 1318485.8, filed Oct. 18, 2013.

BACKGROUND TO THE INVENTION

A voting booth (also commonly known as a polling booth) is an area, provided within a polling station, for voters to cast their vote. In order to protect the secrecy of the vote, it is necessary to provide the voters with a private area within the polling station, usually by providing a voting compartment. Usually, access to the voting compartment is restricted to a single voter, with exceptions for voters requiring assistance.

Voting in elections generally takes place over a relatively short period (usually one- or two-days) and only on a periodic basis (often annually). Accordingly, polling stations are usually provided in facilities used for other purposes, such as schools, churches, sports halls, local government offices, or even private homes. Such facilities are not generally equipped to accommodate and administer the voting process, and so there is a need for voting booths that can be easily used for relatively short periods of time in a facility not generally used as a polling station.

The present invention finds utility as a voting booth operable between a collapsed state and an expanded state, thereby providing a temporary voting booth for use as a private area within the polling station for voters to cast their vote when otherwise-used facilities act as a polling station, and which can be easily assembled and/or disassembled for ease of transport and storage during times when the facility does not act as a polling station.

SUMMARY OF THE INVENTION

According to a first aspect of the present invention, there is provided a voting booth assembly comprising at least one extendable panel adapted for positioning the extendable panel adjacent a substantially planar structure to define a voting compartment between the extendable panel and the substantially planar structure.

Optionally, the at least one extendable panel is generally planar.

Optionally, the at least one extendable panel is operable between a collapsed position and an extended position.

Optionally, the at least one extendable panel comprises at least two sections. Further optionally, the at least one extendable panel comprises at least two generally planar sections.

Optionally, the at least two sections, optionally the at least two generally planar sections, are adapted for relative motion. Further optionally, the at least two sections, optionally the at least two generally planar sections, are adapted for relative reciprocal motion. Still further optionally, the at least two sections, optionally the at least two generally planar sections, are adapted for relative slidable reciprocal motion. Still further optionally, the at least two sections, optionally the at least two generally planar sections, are adapted for independent relative slidable reciprocal motion.

Optionally, the at least two sections, optionally the at least two generally planar sections, are movably mountable. Further optionally, the at least two sections, optionally the at least two generally planar sections, are slidably mountable.

Optionally, the at least one extendable panel comprises first and second sections.

Optionally, the first section is a generally planar section.

Optionally, the second section is generally planar and adapted to receive the first section. Further optionally, the second section is a generally hollow frame adapted to receive the first section. Still further optionally, the second section is generally planar and adapted to reversibly receive the first section.

Optionally, the first section and the second section are arranged for relative motion, optionally relative reciprocal motion, further optionally relative slidable reciprocal motion, still further optionally independent relative slidable reciprocal motion.

Optionally, in the collapsed position, the at least two sections are coplanar. Further optionally, in the collapsed position, the at least two sections are in a side-by-side relationship. Further optionally, in the collapsed position, the planar face of each at least two sections is in a side-by-side relationship.

Optionally, in the collapsed position, the first section is coplanar with the second section. Further optionally, in the collapsed position, the first section is in side-by-side relationship with the second section. Further optionally, in the collapsed position, the planar face of the first section is in side-by-side relationship with the planar face of the second section.

Optionally, in the collapsed state, the first section is received within the second section. Further optionally, in the collapsed state, the first section is coaxially received within the second section.

Optionally, the at least one extendable panel comprises a stop.

Optionally, the stop is adapted for movement relative to the at least one extendable panel. Further optionally, the stop is adapted for pivotable movement relative to the at least one extendable panel. Still further optionally, the stop is adapted for hingable movement relative to the at least one extendable panel.

Optionally, the stop is mountable to the at least one extendable panel. Further optionally, the stop is pivotably mountable to the at least one extendable panel. Still further optionally, the stop is hingedly mountable to the at least one extendable panel.

Optionally, the stop is mountable to the first section. Further optionally, the stop is pivotably mountable to the first section. Still further optionally, the stop is hingedly mountable to the first section.

Optionally, the stop is generally planar.

Optionally, the stop is operable between an engaged position and a retracted position.

Optionally, in the engaged position, the stop extends from the at least one extendable panel. Further optionally, in the engaged position, the stop extends from the first section.

Optionally, in the retracted position, the stop is coplanar with the at least one extendable panel. Further optionally, in the retracted position, the stop is coplanar with the first section.

Optionally, in use, in the engaged position, the stop extends from the at least one extendable panel to engage, optionally reversibly engage, a substantially planar structure to define a voting compartment between the extendable panel and the substantially planar structure.

Optionally, the at least one extendable panel further comprises a shelf.

Optionally, the shelf is mountable to the at least one extendable panel. Further optionally, the shelf is pivotably mountable to the at least one extendable panel. Still further optionally, the shelf is hingedly mountable to the at least one extendable panel.

Optionally, the shelf is mountable to the second section. Further optionally, the shelf is pivotably mountable to the second section. Still further optionally, the shelf is hingedly mountable to the second section.

Optionally, the shelf is operable between an engaged position and a retracted position.

Optionally, in the engaged position, the shelf extends from the at least one extendable panel. Further optionally, in the engaged position, the shelf extends from the second section.

Optionally, in the retracted position, the shelf is coplanar with the at least one extendable panel. Further optionally, in the retracted position, the shelf is coplanar with the second section.

Optionally, in the engaged position, the at least one extendable panel and the shelf are positioned adjacent a substantially planar structure and define a voting compartment therebetween.

Optionally, each extendable panel has a first edge and a second edge. Further optionally, each extendable panel has a first edge and an opposing second edge.

Optionally, in use, the second edge of each extendable panel is positioned adjacent a substantially planar structure and define a voting compartment between the extendable panel and the substantially planar structure. Further optionally, in use, the second edge of each extendable panel is positioned to engage a substantially planar structure and define a voting compartment between the extendable panel and the substantially planar structure.

Optionally, in use, in the engaged position, the stop extends from the second edge of each extendable panel to engage, optionally reversibly engage, a substantially planar structure to define a voting compartment between the extendable panel and the substantially planar structure.

Optionally or additionally, in use, in the engaged position, the stop extends from the first edge of each extendable panel to engage, optionally reversibly engage, a substantially planar structure to define a voting compartment between the extendable panel and the substantially planar structure.

According to a second aspect of the present invention, there is provided a voting booth assembly comprising at least two extendable panels adapted for positioning each extendable panel adjacent a substantially planar structure to define a voting compartment between each pair of extendable panels and the substantially planar structure.

Optionally, the voting booth assembly comprises first and second extendable panels adapted for positioning each extendable panel adjacent a substantially planar structure to define a voting compartment between the first and second extendable panels and the substantially planar structure.

Optionally, in use, the second edge of each extendable panel is positioned adjacent a substantially planar structure and define a voting compartment between the first and second extendable panels and the substantially planar structure. Further optionally, in use, the second edge of each extendable panel is positioned to engage a substantially planar structure and define a voting compartment between the first and second extendable panels and the substantially planar structure.

Optionally, the substantially planar structure is a wall. Alternatively, the substantially planar structure is a panel.

Optionally, substantially planar structure is a panel adapted to extend between each pair of extendable panels.

Optionally, the substantially planar structure is a frame. Alternatively, the substantially planar structure is a planar panel.

Optionally, the substantially planar structure is an extendable panel.

Optionally, the substantially planar structure is the shelf.

According to a third aspect of the present invention, there is provided a voting booth assembly comprising at least three extendable panels adapted for positioning relative to each other to define a voting compartment therebetween.

Optionally, the voting booth assembly comprises first, second, and third extendable panels adapted for positioning relative to each other to define a voting compartment therebetween.

Optionally, in use, the second edge of the first extendable panel is positioned adjacent the first edge of the second extendable panel, and the second edge of the second extendable panel is positioned adjacent the first edge of the third extendable panel, thereby defining a voting compartment between the first, second, and third extendable panels. Further optionally, in use, the second edge of the first extendable panel is positioned to engage the first edge of the second extendable panel, and the second edge of the second extendable panel is positioned to engage the first edge of the third extendable panel, thereby defining a voting compartment between the first, second, and third extendable panels.

According to a fourth aspect of the present invention, there is provided a voting booth assembly comprising at least four extendable panels adapted for positioning relative to each other to define a voting compartment between each pair of extendable panels.

Optionally, the voting booth assembly comprises first, second, third and fourth extendable panels adapted for positioning relative to each other to define a voting compartment between each pair of extendable panels.

Optionally, in use, the second edge of each extendable panel is positioned adjacent the second edge of each other extendable panel. Further optionally, in use, the second edge of each extendable panel is positioned to engage the second edge of each other extendable panel. Still further optionally, in use, the second edge of each extendable panel is positioned adjacent the second edge of each other extendable panel to form a common spine. Still further optionally, in use, the second edge of each extendable panel is positioned adjacent the second edge of each other extendable panel to form a common spine from which the first edge of each extendable panel extends radially.

According to a fifth aspect of the present invention, there is provided a kit comprising at least one extendable panel adapted for positioning the extendable panel adjacent a substantially planar structure to define a voting compartment between the extendable panel and the substantially planar structure; and instructions for use.

BRIEF DESCRIPTION OF THE DRAWINGS

Non-limiting embodiments of the present invention will now be described with reference to the accompanying drawings in which.

DETAILED DESCRIPTION OF THE INVENTION

Figure 1:
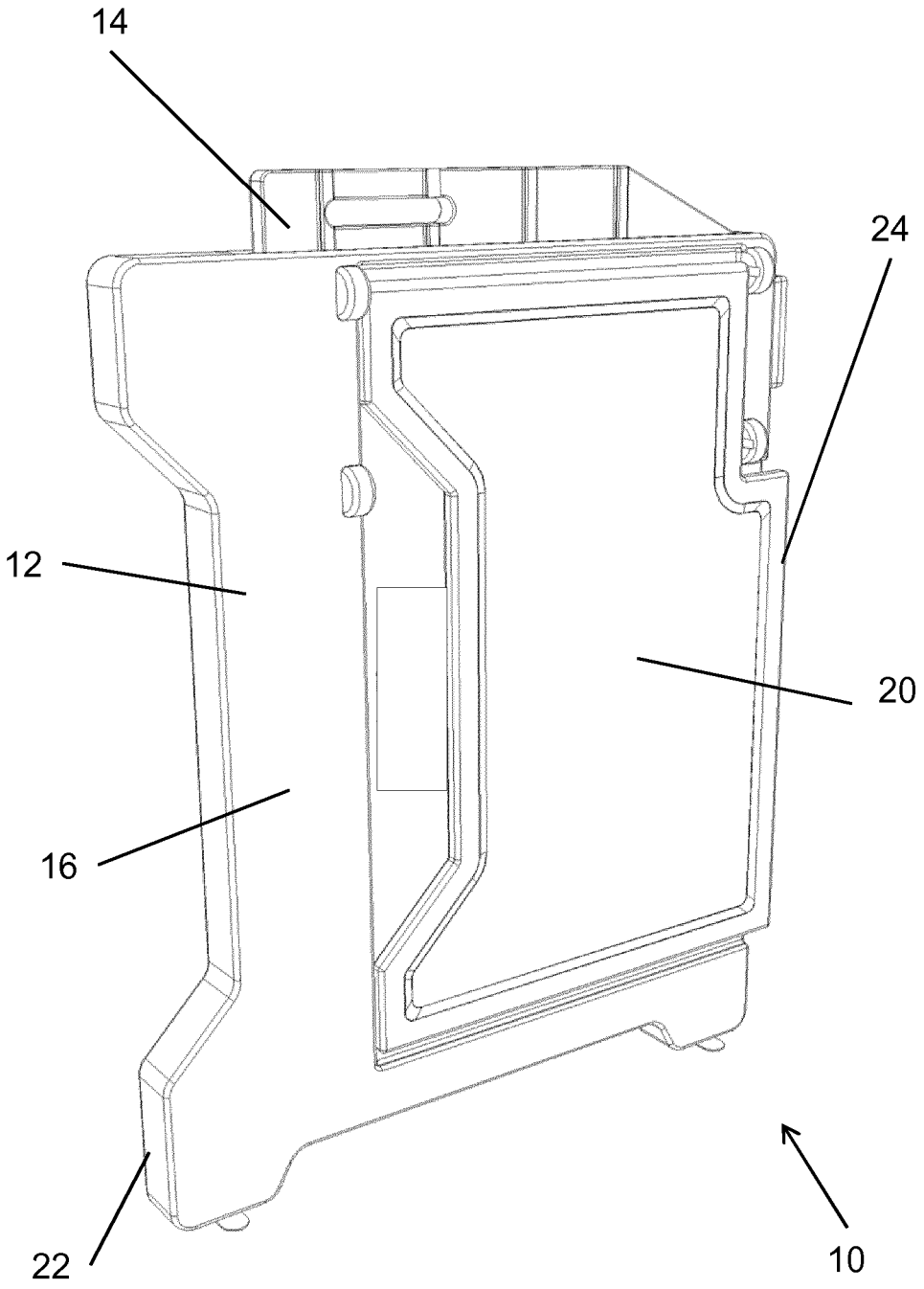
FIG. 1 is a perspective view of an extendable panel of a voting booth assembly according to the present invention in the collapsed position.

Referring to FIG. 1, there is shown a voting booth assembly 10 according to a first embodiment of the present invention. The voting booth assembly 10 comprises an extendable panel 12 adapted to be positioned adjacent a substantially planar structure, such as a wall or vertically oriented panel, to define a voting compartment between the extendable panel 12 and the substantially planar structure (not shown). The extendable panel 12 is generally planar, and is operable between a collapsed position and an extended position. In FIG. 1, the extendable panel is shown in the collapsed position.

Figure 2:
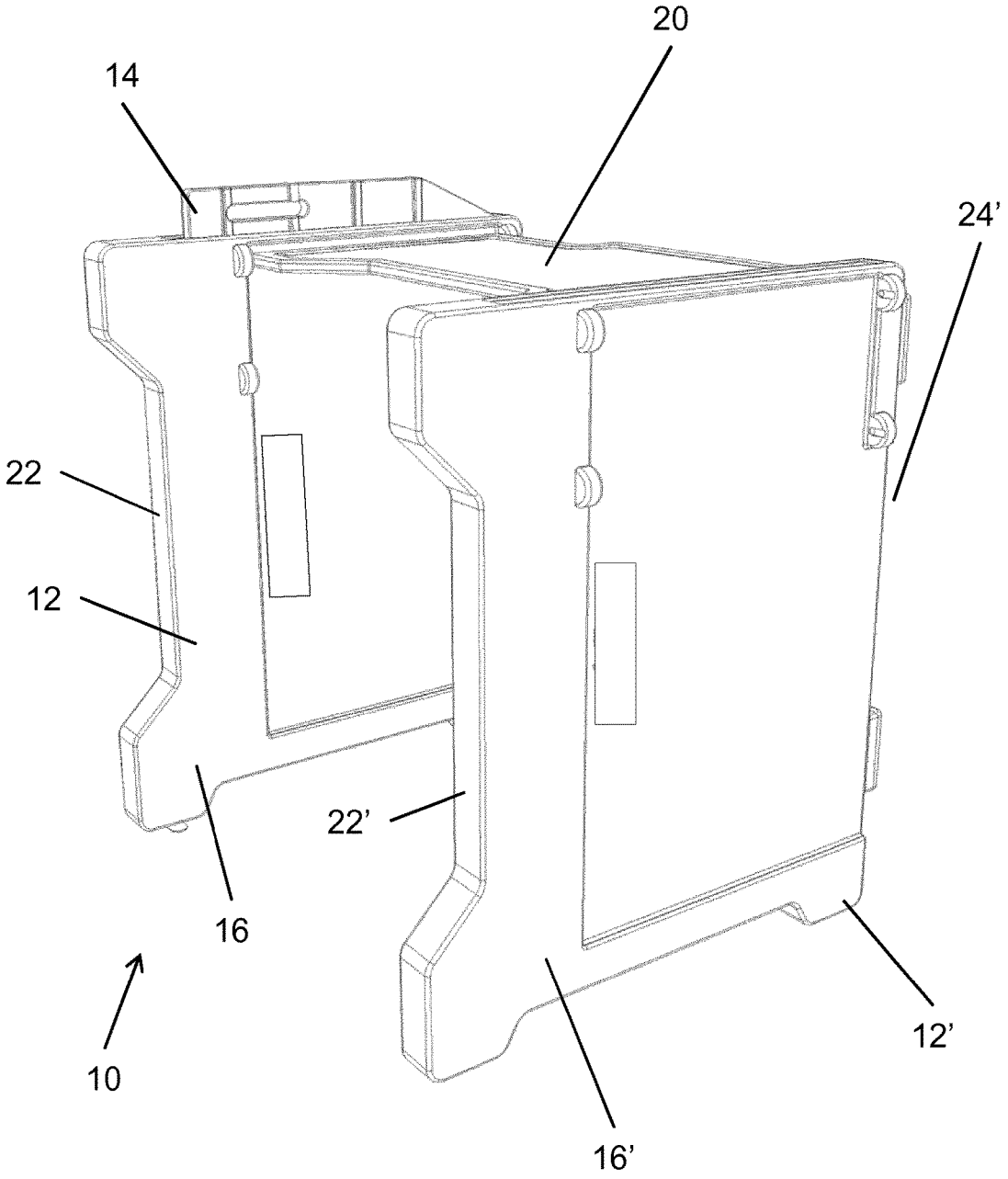
FIG. 2 is a perspective view of a voting booth assembly according to an embodiment of the present invention having first and second extendable panels.
Figure 3:
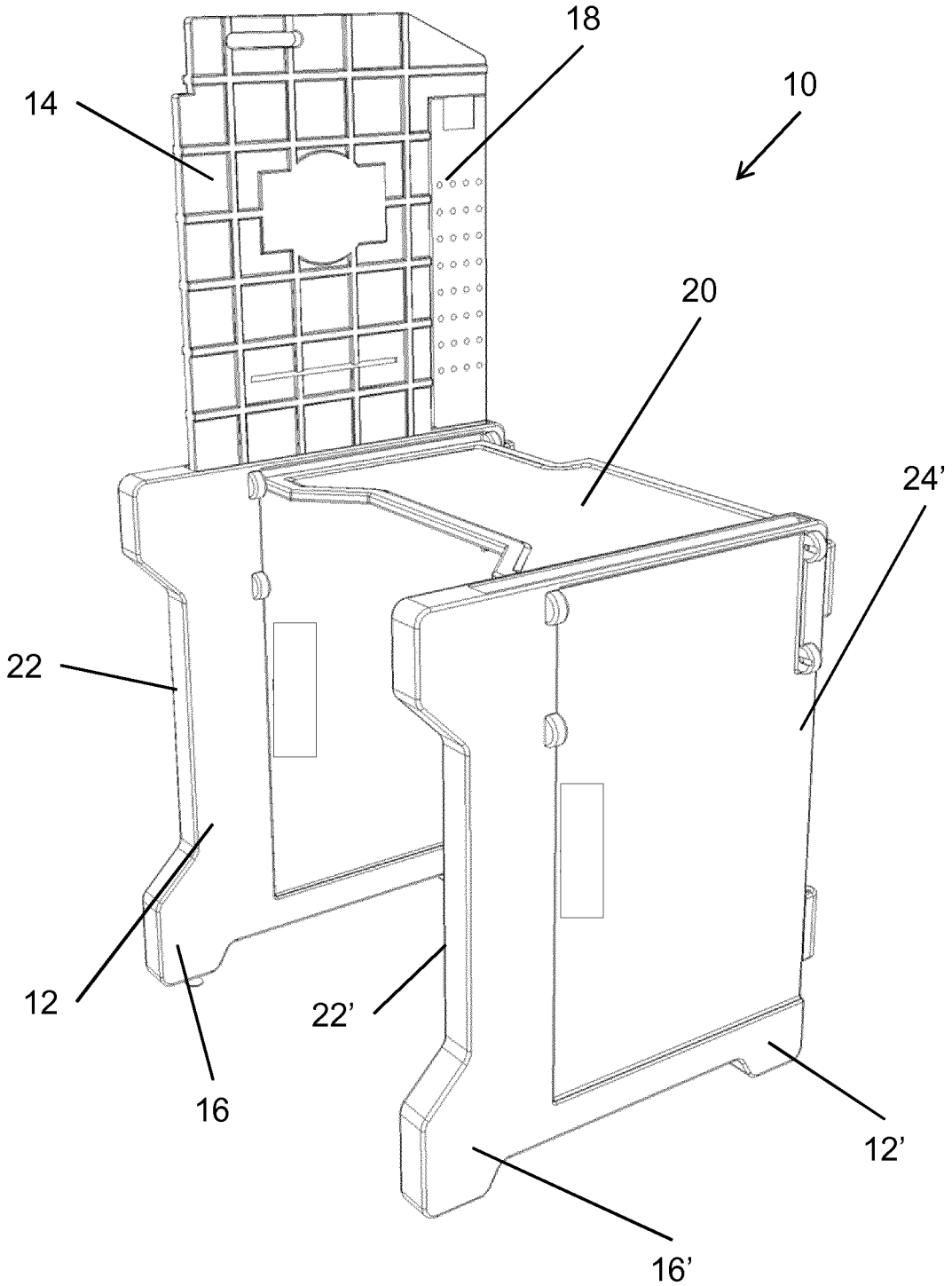
FIG. 3 is a perspective view of a the voting booth assembly of FIG. 2 having the extendable panel in the extended position and the stop in the retracted position.
Figure 4:
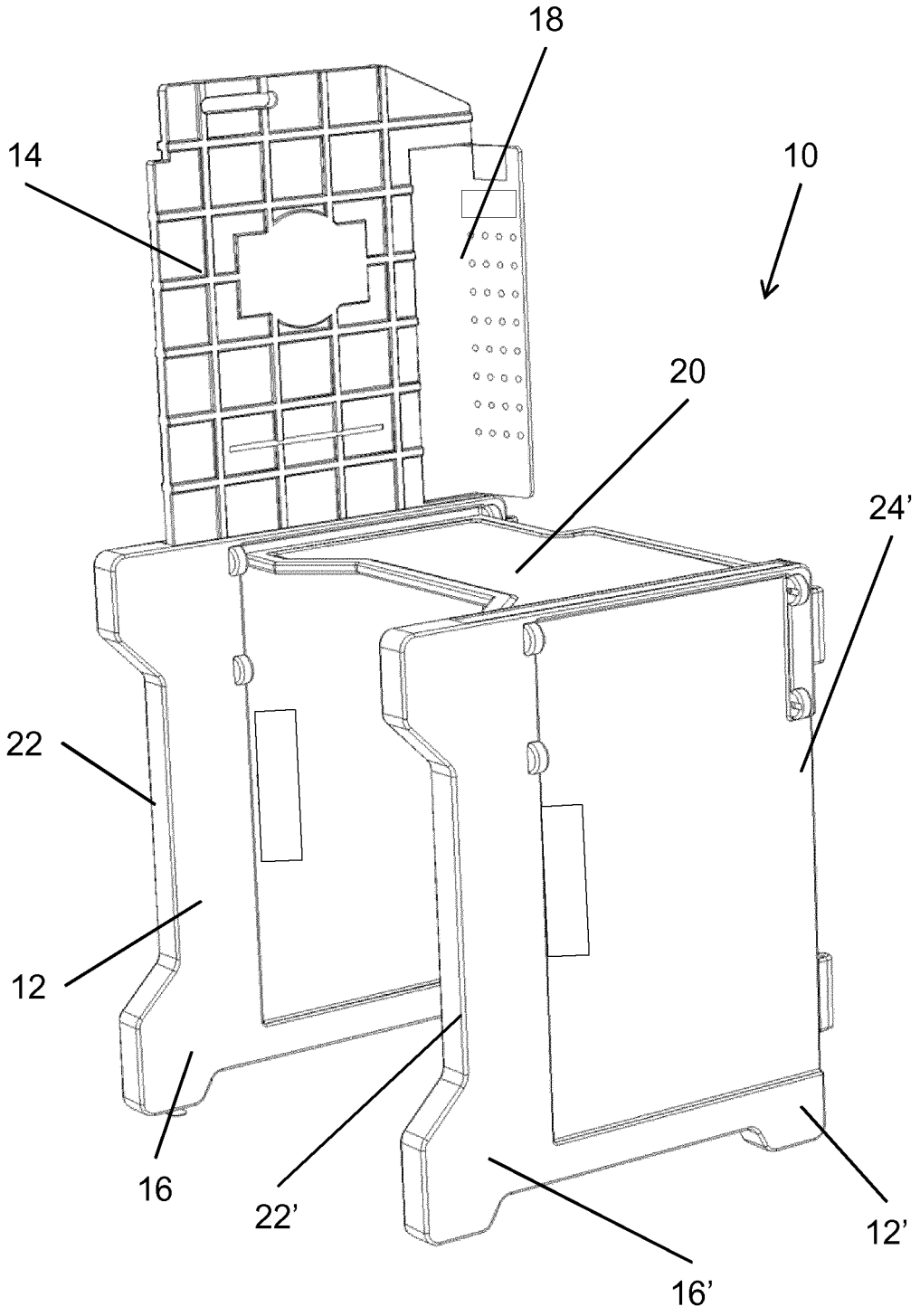
FIG. 4 is a perspective view of a the voting booth assembly of FIG. 3 having the extendable panel in the extended position and the stop in the engaged position.

The extendable panel 12 can comprise at least two sections and, in certain embodiments, the extendable panel 12 comprises two sections 14, 16. The sections 14, 16 comprise generally planar sections, and which can be adapted for relative motion. The two sections 14, 16 can be adapted for relative reciprocal motion, for example relative slidable reciprocal motion, but can be adapted for any form of relative motion that allows the extendable panel 12 to be operable between a collapsed position and an extended position. In operation, the sections 14, 16 are adapted for independent relative slidable reciprocal motion to permit operation of the extendable panel 12 between a collapsed position (as shown in FIGS. 1 and 2) and an extended position (as shown in FIGS. 3 and 4).

In some embodiments, the two sections 14, 16 are movably mountable to permit the relative motion. For example, the two sections 14, 16 can be adapted to comprise a slidable coupling, to be slidably mountable. In such an embodiment, the extendable panel comprises first 14 and second 16 sections. The first section 14 can comprise a guide or rail and the second section 16 can comprise a projection to be received within the guide or rail of the first section 14, thereby forming a slidable coupling.

In another embodiment, each of the sections 14, 16 is a generally planar section. The second section 16 is generally planar and adapted to receive the first section 14. For example, the second section 16 can be a generally hollow frame adapted to receive, optionally reversibly receive, the first section 14 therewithin. The second section 16 can comprise a frame defining a cavity, which cavity is shaped and dimensioned to receive, or at least partially receive, the first section 14. In this way, the first section 14 and the second section 16 are arranged for relative motion, optionally relative reciprocal motion, further optionally relative slidable reciprocal motion, still further optionally independent relative slidable reciprocal motion.

When the extendable panel comprises first 14 and second 16 sections, in the collapsed position, the two sections 14, 16 are coplanar, or in a side-by-side relationship, for example, wherein the planar face of each at least two sections 14, 16 is in a side-by-side relationship. When adapted for independent relative slidable reciprocal motion, in the collapsed state, the first section 14 is received, optionally coaxially received, within the second section 16.

Referring now to FIG. 3, there is shown an embodiment of the voting booth assembly 10, in which the extendable panel 12 is in the extended position. The extendable panel 12 comprises a stop 18. The stop 18 is adapted for movement relative to the extendable panel 12. In this embodiment, the stop 18 is adapted for pivotable movement relative to the extendable panel 12. The stop 18 can be adapted for hingable movement relative to the extendable panel 12. For example, in certain embodiments, the stop 18 can be mountable, optionally pivotably mountable, to the extendable panel 12, for example, the stop 18 can be hingedly mountable to the extendable panel 12 by way of a hinge bearing, such as a continuous hinge or piano hinge. The stop 18 can be mountable to the first section 14.

In preferred embodiments, the stop 18 is generally planar and, in some embodiments the stop 18 is generally planar and elongate. The stop 18 is operable between an engaged position and a retracted position, and is shown in FIG. 3 in the extended position and shown in FIG. 4 in the engaged position. In the engaged position, the stop 18 extends from the extendable panel 12 and, in some embodiments, in the engaged position, the stop 18 extends from the first section 14. In the retracted position, the stop 18 is coplanar with the extendable panel 12 or the first section 14. When the stop 18 is coplanar with the extendable panel 12 or the first section 14, the first section 14 can be independently slidably received within the second section 16, or the planar face of each at least two sections 14, 16 can be in a side-by-side relationship.

In use, in the engaged position, the stop 18 extends or projects from the extendable panel 12 to engage, optionally reversibly engage, the substantially planar structure, thereby defining a voting compartment between the extendable panel 12 and the substantially planar structure, by defining a privacy screen extending between the extendable panel 12 and the substantially planar structure, and occluding the view outside the voting compartment.

The extendable panel can further comprise a shelf 20. The shelf 20 is mountable to the extendable panel 12, for example pivotably mountable to the extendable panel 12. The shelf 20 can be hingedly mountable to the extendable panel 12. In some embodiments, the shelf 20 is mountable to the second section 16, optionally at an externally facing face of the second section 16. For example, the shelf 20 can be pivotably mountable to the second section 16, such as hingedly mountable as described above herein.

The shelf 20 is operable between an engaged position and a retracted position. In the retracted position shown in FIG. 1, the shelf 20 is coplanar with the extendable panel 12 or with the second section 16. In the engaged position shown in FIGS. 2 and 3, the shelf 20 extends from the extendable panel 12 or from the second section 16. In FIGS. 2 and 3, the shelf is shown as extending from a first extendable panel 12 to a second extendable panel 12', but it is understood that the shelf 20 can extend from the extendable panel 12 or from the second section 16 to any other suitable support. For example, in one embodiment, in the engaged position, the extendable panel 12 and the shelf 20 are positioned adjacent a substantially planar structure and define a voting compartment therebetween.

Each extendable panel 12 has a first edge 22 and a second edge 24. The first edge 22 and the second edge 24 are opposing edges of the extendable panel 12. In use, the second edge 24 of each extendable panel 12 is positioned adjacent a substantially planar structure to define a voting compartment between the extendable panel 12 and the substantially planar structure. Further optionally, in use, the second edge 24 of each extendable panel 12 is positioned to engage the substantially planar structure and define a voting compartment. In certain embodiments, in use, in the engaged position, the stop 18 extends from the second edge 24 of each extendable panel 12 to engage, optionally reversibly engage, the substantially planar structure to define a voting compartment between the extendable panel and the substantially planar structure, and thereby acting as a privacy screen to occlude a view between the extendable panel and the substantially planar structure. In other embodiments, in use, in the engaged position, the stop 18 can additionally extend from the first edge 22 of each extendable panel 12 to define a privacy screen to occlude a view about the first edge 22 of the extendable panel 12.

Figure 5:
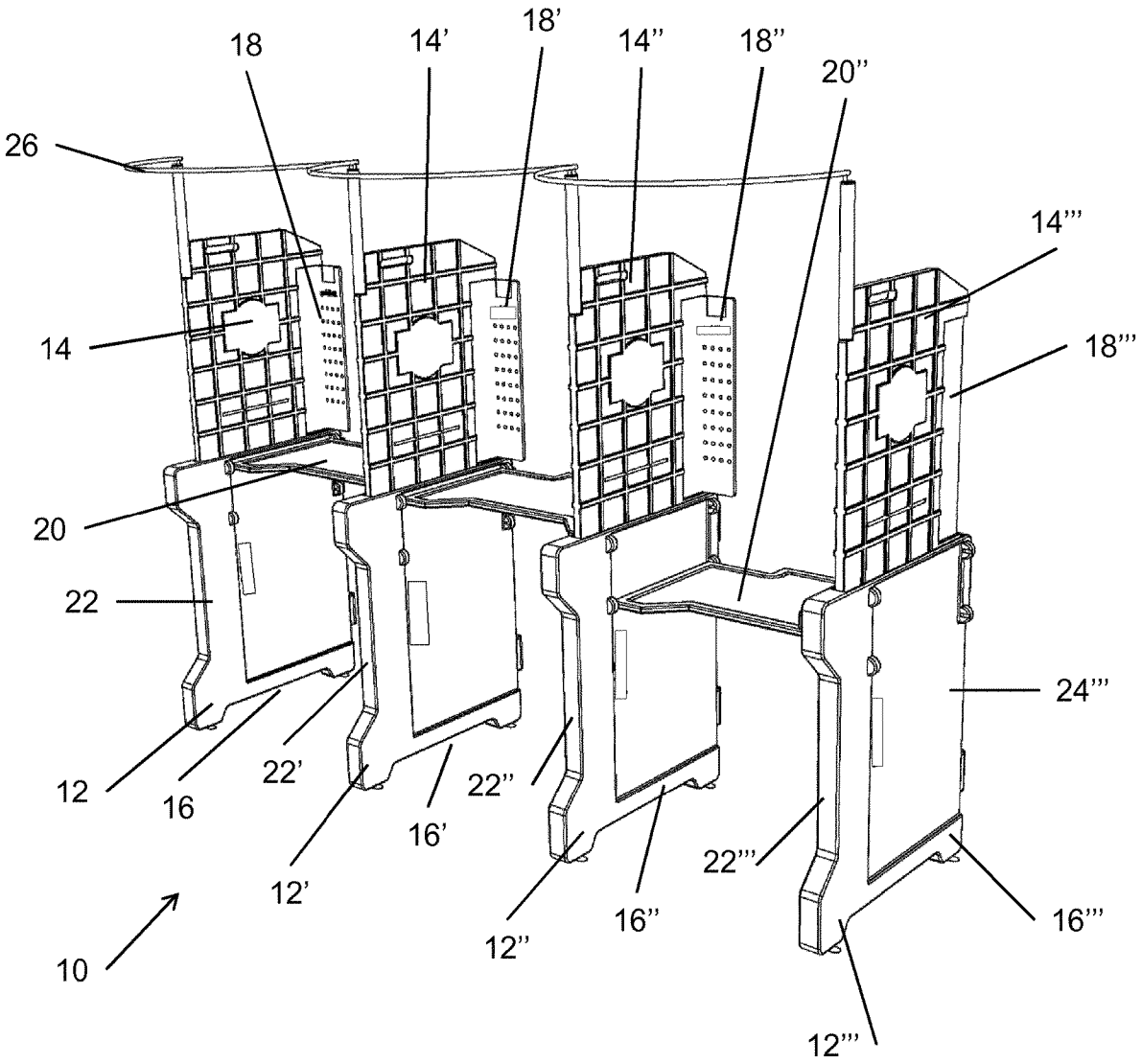
FIG. 5 is a perspective view of a voting booth assembly according to a further embodiment of the present invention having first, second, third, and fourth extendable panels.

According to a second embodiment, the present invention relates to a voting booth assembly 10 comprising first 12 and second 12' extendable panels. Each panel 12, 12' is adapted for positioning adjacent a substantially planar structure to define a voting compartment between the first 12 and second 12' extendable panels and the substantially planar structure. As shown in FIGS. 2-4, for example, in use, the second edge 24 of each extendable panel 12, 12' can be positioned adjacent a substantially planar structure, such as a wall, and define a voting compartment between the first 12 and second 12' extendable panels and the substantially planar structure (not shown). In use, the second edge 24 of each extendable panel 12, 12' is positioned to engage the substantially planar structure and define a voting compartment between the first 12 and second 12' extendable panels and the substantially planar structure. The substantially planar structure can be a wall, or the substantially planar structure can be a separate panel, which can be adapted to extend between each pair of extendable panels 12, 12'. In some embodiments, the substantially planar structure is a frame or a planar panel, which can extend between each pair of extendable panels 12, 12'. In certain embodiments, the substantially planar structure is the shelf 20, as shown in FIGS. 2 and 3. As shown in FIG. 5, each pair of extendable panels 12, 12' can be arranged, optionally positioned, further optionally engaged, in a series to form a linear series of voting compartments.

Figure 6:
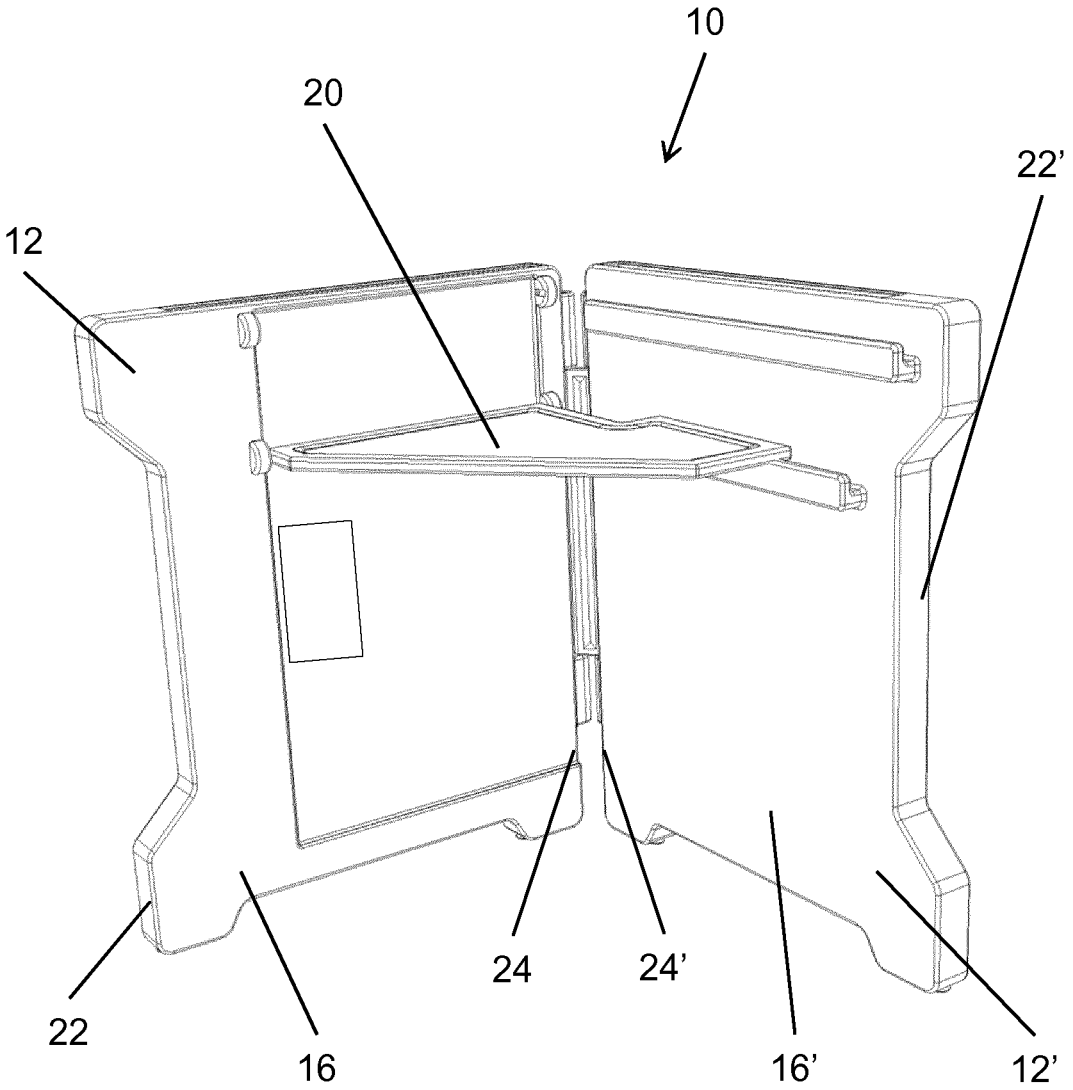
FIG. 6 is a perspective view of a voting booth assembly according to a still further embodiment of the present invention having first and second extendable panels.

In an embodiment shown in FIG. 6, the substantially planar structure is an extendable panel 12 of the present invention. In such an embodiment, the first 22 and second 24 edges of each extendable panel can comprise a coupling for engaging, optionally reversibly engaging, each adjacent extendable panel 12'. Optionally, the coupling permits movement of a first extendable panel 12 relative to a second 12' adjacent extendable panel. In this embodiment, the coupling is arranged for pivotable movement of a first extendable panel 12 relative to an adjacent second extendable panel 12'. The coupling can be arranged for hingable movement between adjacent extendable panels 12, 12', for example, the first 12 and adjacent second 12' extendable panels can be hingedly mountable to each other by way of a hinge bearing, such as a continuous hinge or piano hinge.

Each extendable panel 12 can be provided with a spine member at the first 22 and/or second 24 edge of the extendable panel, each spine member being pivotably coupled to at least one adjacent spine member. Each spine member may be integral with, or separable from, the respective extendable panel 12. First and second pivotable couplings between adjacent spine members may be provided by means of a linking member comprising a neck having first and second opposed ends, each end being adapted for pivotable engagement with an adjacent spine member. Each spine member may comprise a plate having first and second terminal ends, each end being adapted for pivotable engagement with the linking member. The first and second pivotable coupling of the linking member with respect to adjacent spine members may be provided by a hinge joint comprising a substantially cylindrical member pivotable in a correspondingly shaped socket.

Each spine member may be provided, at the first and second terminal ends, with first and second sockets and each linking member may be provided, at first and second opposed ends, with first and second substantially cylindrical members. Alternatively, each spine member may be provided, at the first and second terminal ends, with first and second substantially cylindrical members and each linking member may be provided, at first and second opposed ends, with first and second sockets. Further alternatively, each spine member may be provided, at the first and second terminal ends, with either a first socket and a second substantially cylindrical member or a first substantially cylindrical member and a second socket and each linking member may be provided, at the first and second opposed ends, with either a first substantially cylindrical member and a second socket or a first socket and a second substantially cylindrical member, respectively.

The first and second pivotable couplings between adjacent spine members may be by means of a female connector provided on each spine member (preferably at terminal ends of each spine member) and a corresponding linking member having male connectors (preferably at opposed ends of each linking member) pivotable with respect to the female connectors on adjacent spine members. The female connector may define an elongated partial torus-shaped space, to accommodate, in use, a correspondingly shaped and dimensioned substantially cylindrical member. Alternatively, the pivotable coupling between adjacent spine members may be by means of a male connector provided on each spine member (preferably at terminal ends of each spine member) and a corresponding linking member having female connectors engageable with the male connectors on adjacent spine members. Further alternatively, the pivotable coupling between adjacent spine members may be by means of a male connector provided at one end of the spine member and a female connector provided at the other end of the spine member (or vice versa) and the linking member has corresponding female and male connectors engageable with the male and female connectors of adjacent spine members, respectively. In the preferred embodiment, a female connector is provided at terminal ends of each spine member and the linking member has a correspondingly shaped and dimensioned male connector for each female connector. Advantageously, the male and female connectors are pivotable with respect to one another when engaged. Typically, adjacent spine members are pivotable about a respective in use vertical axis. The coupling between at least one pair of adjacent spine members is removable or disengageable to allow the booth to be assembled or disassembled. Alternatively, said coupling may be omitted.

Accordingly, the present invention also provides a voting booth assembly comprising at least three extendable panels 12, 12', 12", each adapted for positioning relative to each other to define a voting compartment therebetween. In such an embodiment, the voting booth assembly comprises first 12, second 12', and third 12" extendable panels adapted for positioning relative to each other to define a voting compartment therebetween. In use, the second edge 24 of the first extendable panel 12 is positioned adjacent the first edge 22 of the second extendable panel 12', and the second edge 24 of the second extendable panel 12' is positioned adjacent the first edge 22 of the third extendable panel 12", thereby defining a voting compartment between the first 12, second 12', and third 12" extendable panels. The second edge 24 of the first extendable panel 12 can be positioned to engage the first edge 22 of the second extendable panel 12', and the second edge 24 of the second extendable panel 12' can be positioned to engage the first edge 22 of the third extendable panel 12", thereby defining a voting compartment between the first 12, second 12', and third 12" extendable panels. Each of the extendable panels 12, 12', 12" can be engaged by the coupling mechanism described above herein.

Figure 7:
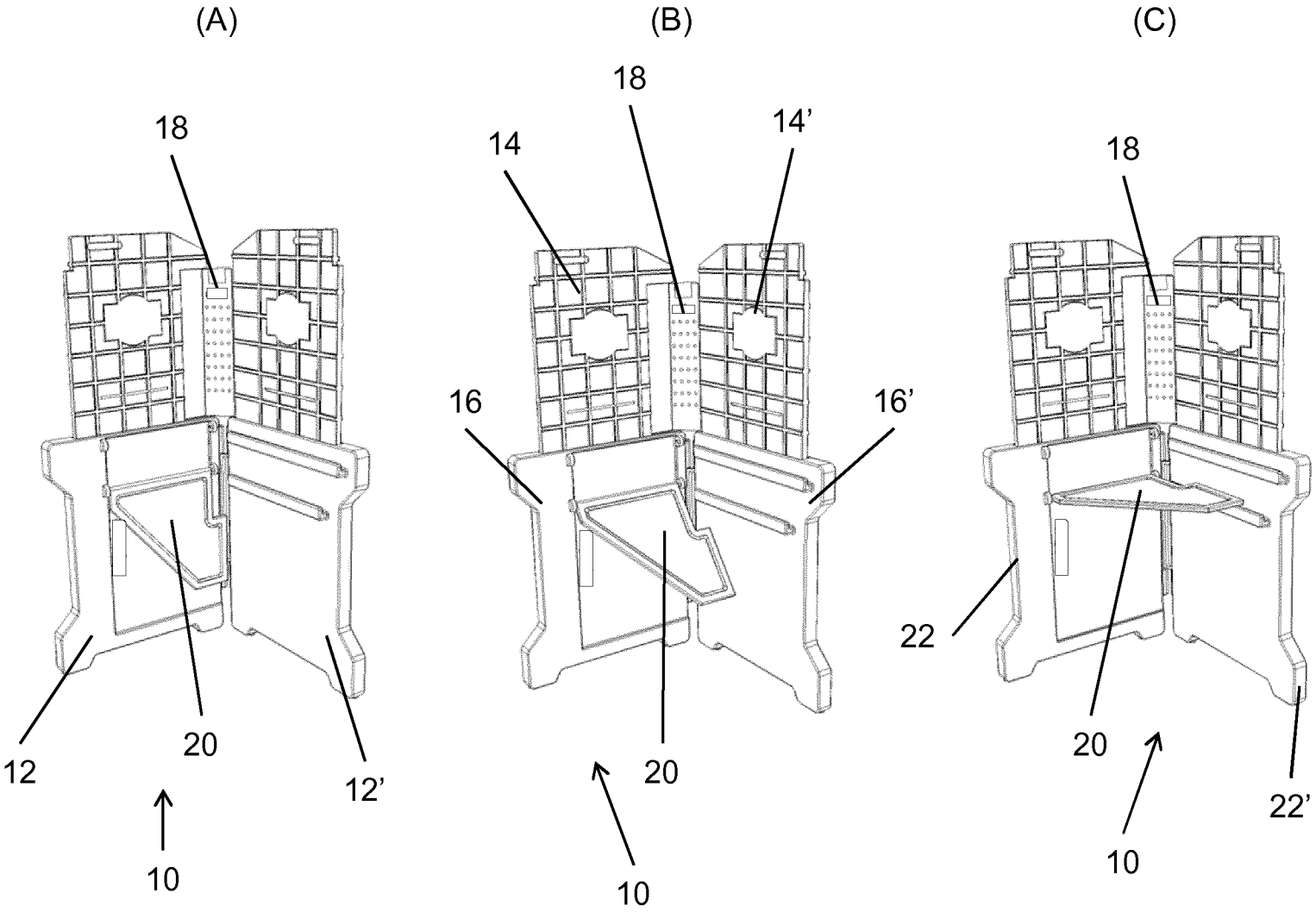
FIG. 7 is a perspective view of the voting booth assembly of FIG. 6 in operation.
Figure 8:
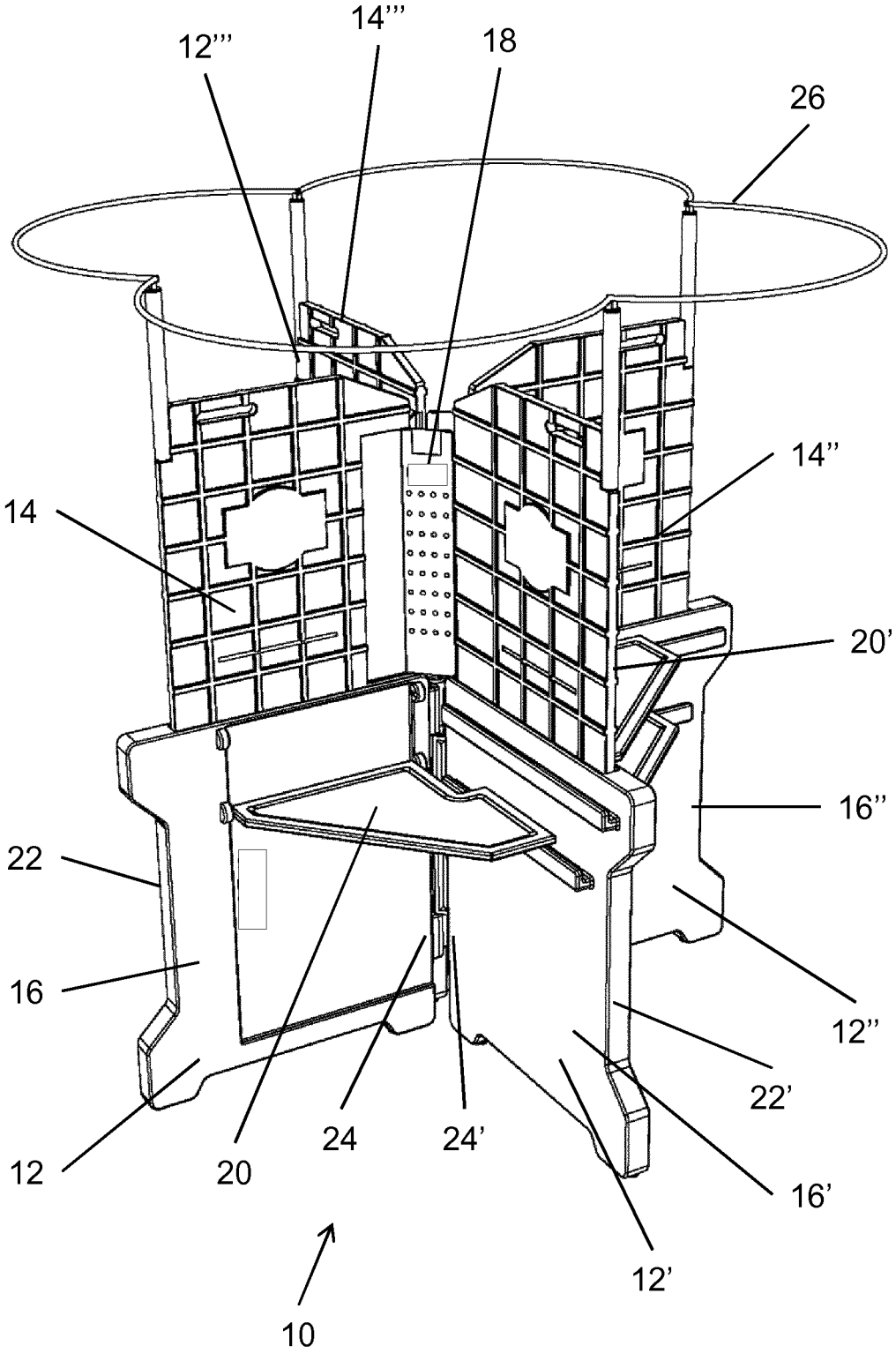
FIG. 8 is a perspective view of the voting booth assembly of FIG. 6 in use.

As shown in FIGS. 7 and 8, the present invention also provides a voting booth assembly 10 comprising at least four extendable panels 12, 12', 12", 12"', each adapted for positioning relative to each other to define a voting compartment between each pair of extendable panels. The voting booth assembly 10 comprises first 12, second 12', third 12", and fourth 12"' extendable panels adapted for positioning relative to each other to define a voting compartment between each pair of extendable panels. In use, the second edge 24 of each extendable panel 12, 12', 12", 12"' is positioned adjacent the second edge 24 of each other extendable panel 12, 12', 12", 12"; thereby forming a cruciform configuration. The second edge 24 of each extendable panel 12, 12', 12", 12"' can be positioned to engage the second edge 24 of each other extendable panel by way of the coupling mechanism described herein above; optionally wherein, in use, the second edge 24 of each extendable panel 12, 12', 12", 12"' is positioned adjacent the second edge 24 of each other extendable panel 12, 12', 12", 12"' to form a common spine from which the first edge 22 of each extendable panel 12, 12', 12", 12"' extends radially.

The invention also provides a kit comprising at least one extendable panel 12 adapted for positioning the extendable panel 12 adjacent a substantially planar structure to define a voting compartment between the extendable panel 12 and the substantially planar structure; and instructions for use.

Each extendable panel 12 may further comprise a curtain rail 26 and optionally a curtain (not shown) which may be positioned relative to the voting compartment to occlude the view of the voting compartment. Optionally the curtain rail 26 comprises first and second ends. Optionally, the curtain rail 26 is reversibly attachable to the first section 14 of the extendable panel 12. Further optionally, the first end of the curtain rail 26 is reversibly attachable to the first section 14 and the second end may be attached to a substantially planar structure (for example, a wall) or to an adjacent first section 14' of a second extendable panel 12'. Advantageously, the curtain rail 26 is removable or disengageable from the extendable panel 12 to allow the voting booth assembly 10 to be easily assembled or disassembled.

Figure 9:
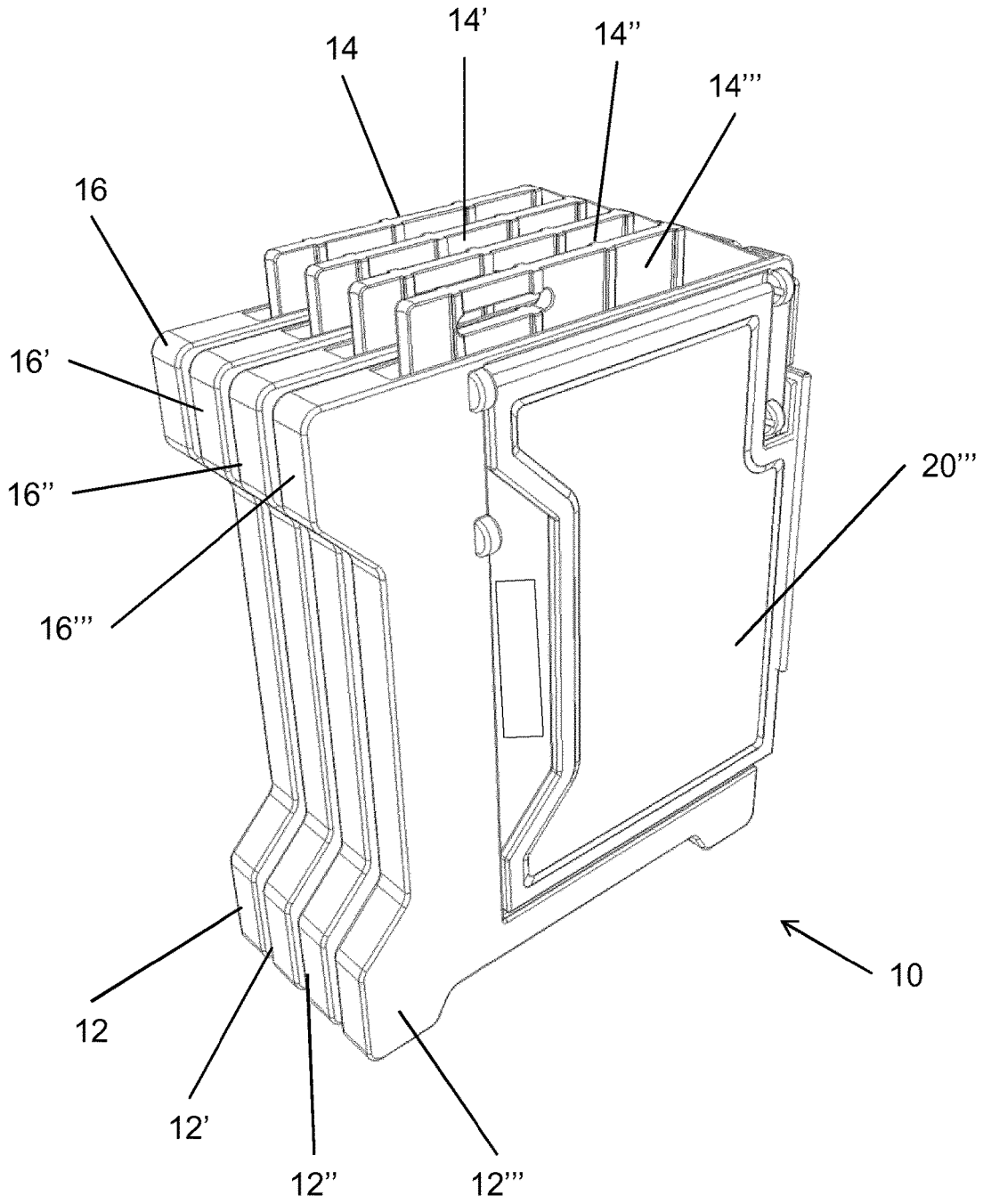
FIG. 9 is a perspective view of the voting booth assembly of FIG. 6 not in use.

When not in use, the extendable panels 12, 12', 12", 12"' of the voting booth assembly 10 of the present invention can be arranged such that each extendable panel 12, 12', 12", 12"', or the planar face of each extendable panel 12, 12', 12", 12"' is in a side-by-side relationship, as shown in FIG. 9, thereby facilitating ease of transport and storage during times when a facility does not act as a polling station.

Accordingly, the present invention can also find utility as modular furniture operable between a collapsed state and an expanded state, thereby providing a temporary piece of furniture, for example a desk or table, for use as a private area within facilities such as schools, churches, sports halls, local government offices, or even private homes, and which can be easily assembled and/or disassembled for ease of transport and storage during times when the modular furniture is not in use.

The invention claimed is:

1. A voting booth assembly comprising at least one extendable panel, operable between a collapsed position and an extended position, wherein the at least one extendable panel comprises first and second sections adapted for relative slidable reciprocal motion, wherein the first section is a generally planar section, and the second section is generally planar and adapted to receive the first section; and wherein, in the collapsed state, the first section is received within the second section and adapted for positioning the extendable panel adjacent a substantially planar structure to define a voting compartment between the extendable panel and the substantially planar structure; wherein the at least one extendable panel further comprises a shelf pivotably mountable to the at least one extendable panel, and the shelf is operable between an engaged position and a retracted position.

2. The voting booth assembly according to claim 1, wherein the at least one extendable panel comprises a stop adapted for pivotable movement relative to the at least one extendable panel, and the stop is operable between an engaged position and a retracted position.

3. The voting booth assembly according to claim 2, wherein each extendable panel has a first edge and an opposing second edge, and wherein, in use, the second edge of each extendable panel is positioned adjacent a substantially planar structure to define a voting compartment between the extendable panel and the substantially planar structure.

4. The voting booth assembly according to claim 3, wherein, in use, in the engaged position, the stop extends from the second edge of each extendable panel to engage a substantially planar structure to define a voting compartment between the extendable panel and the substantially planar structure.

5. A voting booth assembly comprising at least two extendable panels according to claim 1.

6. The voting booth assembly according to claim 5, wherein the voting booth assembly comprises first and second extendable panels adapted for positioning each extendable panel adjacent a substantially planar structure to define a voting compartment between the first and second extendable panels and the substantially planar structure.

7. The voting booth assembly according to claim 6, wherein, in use, the second edge of each extendable panel is positioned adjacent a substantially planar structure to define a voting compartment between the first and second extendable panels and the substantially planar structure.

8. The voting booth assembly according to claim 6, wherein the substantially planar structure is a frame.

9. The voting booth assembly according to claim 6, wherein the substantially planar structure is an extendable panel.

10. The voting booth assembly according to claim 6, wherein the substantially planar structure is a shelf.

11. A voting booth assembly comprising at least three extendable panels according to claim 1, each extendable panel adapted for positioning relative to each other to define a voting compartment therebetween.

12. The voting booth assembly according to claim 11, wherein the voting booth assembly comprises first, second, and third extendable panels adapted for positioning relative to each other to define a voting compartment therebetween.

13. A voting booth assembly according to claim 11, wherein, in use, a second edge of the first extendable panel is positioned adjacent a first edge of the second extendable panel, and a second edge of the second extendable panel is positioned adjacent a first edge of the third extendable panel, thereby defining a voting compartment between the first, second, and third extendable panels.

14. A kit comprising:

at least one extendable panel according to claim 1, and adapted for positioning the extendable panel adjacent a substantially planar structure to define a voting compartment between the extendable panel and the substantially planar structure; and instructions for using the extendable panel.

* * * * *